US008005378B2

(12) United States Patent
Sheflin et al.

(10) Patent No.: US 8,005,378 B2
(45) Date of Patent: Aug. 23, 2011

(54) METHOD AND SYSTEM FOR IMPROVED CONTROL PATCH MEASUREMENT IN PRINTING SYSTEM

(75) Inventors: Joseph Sheflin, Macedon, NY (US); Jack LeStrange, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 865 days.

(21) Appl. No.: 11/931,721

(22) Filed: Oct. 31, 2007

(65) Prior Publication Data

US 2009/0110420 A1 Apr. 30, 2009

(51) Int. Cl.
*G03G 15/00* (2006.01)

(52) U.S. Cl. ..... 399/49; 399/160

(58) Field of Classification Search ..... 399/49, 399/160

See application file for complete search history.

(56) References Cited

U.S. PATENT DOCUMENTS

| | | | | |
|---|---|---|---|---|
| 4,949,105 | A | 8/1990 | Prowak | |
| 5,227,270 | A | 7/1993 | Scheuer et al. | |
| 5,416,563 | A | 5/1995 | Magde, Jr. | |
| 5,463,455 | A | 10/1995 | Pozniakas et al. | |
| 5,826,139 | A | 10/1998 | Nacman et al. | |
| 5,995,775 | A | 11/1999 | Budnik et al. | |
| 6,198,490 | B1 * | 3/2001 | Eom et al. | 399/301 |
| 6,204,869 | B1 | 3/2001 | Raker et al. | |
| 6,526,240 | B1 | 2/2003 | Thomas et al. | |
| 6,697,582 | B1 | 2/2004 | Scheuer | |
| 2003/0031483 | A1 * | 2/2003 | Kondoh | 399/313 |
| 2006/0001911 | A1 | 1/2006 | Viassolo et al. | |
| 2006/0188298 | A1 * | 8/2006 | Aikawa | 399/301 |
| 2008/0025742 | A1 * | 1/2008 | Kato et al. | 399/49 |
| 2008/0075492 | A1 * | 3/2008 | Mestha et al. | 399/49 |

* cited by examiner

*Primary Examiner* — Ryan D Walsh
(74) *Attorney, Agent, or Firm* — Fay Sharpe LLP

(57) ABSTRACT

Printing systems, control systems, and methods are presented for controlling customer image creation in which process control patches are laterally offset from a lateral customer image boundary to mitigate adverse interaction of control patches and customer images and to improve print engine process control.

5 Claims, 11 Drawing Sheets

METHOD AND SYSTEM FOR IMPROVED CONTROL PATCH MEASUREMENT IN PRINTING SYSTEM

BACKGROUND

The present exemplary embodiment relates to document processing systems and more particularly to improved process control patch measurement methods and print control systems. In the present disclosure, methods and systems are provided for print engine control in a document processing system. Electrophotographic laser printers, xerographic copiers, scanners, facsimile machines and other document processing systems are operable to print images and text onto printable media using imaging components operated according to print data. Electrostatic charge is initially distributed on an outer side surface of a photoreceptor or photographic member, which may be a rotating drum or a belt translated in a process direction in the printing engine. A customer image is optically projected on the charged photoreceptor surface using a raster image scanner leaving a latent image on the photoreceptor surface. The image is developed by the photoreceptor translating past a source of toner such that toner particles are drawn to the latent image via a carrier in order to create a visible image on the photoreceptor surface, and the toner image is then transferred to paper or other printable media and is fused to the media to create a printed document. Following the printing cycle, the photoreceptor is discharged before the photoreceptor is again charged for printing of the next customer image.

To ensure correct operation of the imaging components of a print engine over time, feedback control techniques are employed using feedback obtained from process control or test patches created on the photoreceptor to adjust the operation of the various imaging components of the printing engine. The control patch is a predefined pattern that is created on the photoreceptor surface between adjacent customer images and is sensed or measured as the photoreceptor moves past a sensor. Different patches may be created for different colors, with each patch including light, dark, and medium areas, where more than one sensor may be used to measure the differently colored control patches created on the photoreceptor. Feedback information obtained from the measured control patch is used to adjust operating parameters of the printing system to maintain image quality, such as toner concentration, the magnitude of the charge on the photoreceptor, the amount of exposure from the scanner, etc.

FIG. 12 shows a conventional process control patch implementation in which control patches 130 for each developer housing are created in an inter-document zone (IDZ) 122 between successive customer images 120 on a drum or belt type photoreceptor 110*a* that moves along a process direction P. These control patches 130 are sensed with toner patch sensors (not shown) and actuators are adjusted to maintain a three-point tonal response curve (TRC). However, the inventors have appreciated that shortfalls in system performance, such as reload degradation, can cause undesirable interactions between the control patches and the customer images. In this situation, the presence of the customer image may cause distortion in the control patch image, and thereby lead to an error in the measured process control feedback for the print engine. Likewise, the presence of control patches in the IDZ may cause a distortion in the customer image. Thus, there is a need for improved feedback control techniques and systems for print engine control.

BRIEF DESCRIPTION

The present disclosure provides printing systems and control systems therefor, as well as methods for controlling customer image creation, in which process control patches are created on a moving photoreceptor in edge zones that are laterally offset from a lateral customer image boundary. In this manner, image development system deficiencies with respect to customer images are decoupled from the process control or test patch images on the photoreceptor and vice versa, and accordingly the ability to control the print engine in closed loop fashion will not be adversely impacted by system performance degradation.

One or more aspects of the present disclosure relate to a method for controlling a print engine in a printing system. The method involves creation of images between two lateral edges on a first side of a photoreceptor, where the images are created in predefined customer image areas separated along a process direction by an inter-document zone (IDZ), and where the customer image areas have a lateral boundary inward of the photoreceptor edge. The lateral image area boundary and the IDZ define an edge zone comprising a first portion laterally outside the customer image area between the lateral boundary and the photoreceptor edge alongside the customer image, and a second portion extending laterally outwardly of the lateral boundary through the IDZ. The method includes creating one or more process control patch images within the edge zone of the photoreceptor, sensing the patch image to generate measured control patch feedback information, and controlling the customer image creation in closed-loop fashion at least partially according to the measured control patch feedback information.

In this manner, and image development system problems introduced by a customer image on the photoreceptor will not affect the control patch image, whereby the feedback control will not be impaired or distorted. Moreover, any image development system effects associated with the presence of the control patch images will not affect the customer images created on the photoreceptor, since the control patch and customer images are laterally offset from one another and do not overlap with respect to the process direction along which the photoreceptor is translated. The control patch(es) may be located in either or both the first and/or second portions of the edge zone, and a given patch image may extend into both portions. Edge zones may be defined along both lateral edges of the photoreceptor with the customer image area therebetween, where control patches can be created in one or both such edge zones.

Further aspects of the disclosure relate to printing systems and control systems therefor. The printing system includes a photoreceptor having customer image areas separated by inter-document zones along the process direction and having a first lateral boundary defining an edge zone laterally outward from the customer image area, as well as an imaging component, a sensor operative to sense the control patch images created in the edge zone, and a controller that receives feedback information from the sensor and controls the creation images in closed-loop fashion at least partially according to the measured control patch feedback information.

BRIEF DESCRIPTION OF THE DRAWINGS

The present subject matter may take form in various components and arrangements of components, and in various steps and arrangements of steps. The drawings are only for purposes of illustrating preferred embodiments and are not to be construed as limiting the subject matter.

DETAILED DESCRIPTION

Figure 1:
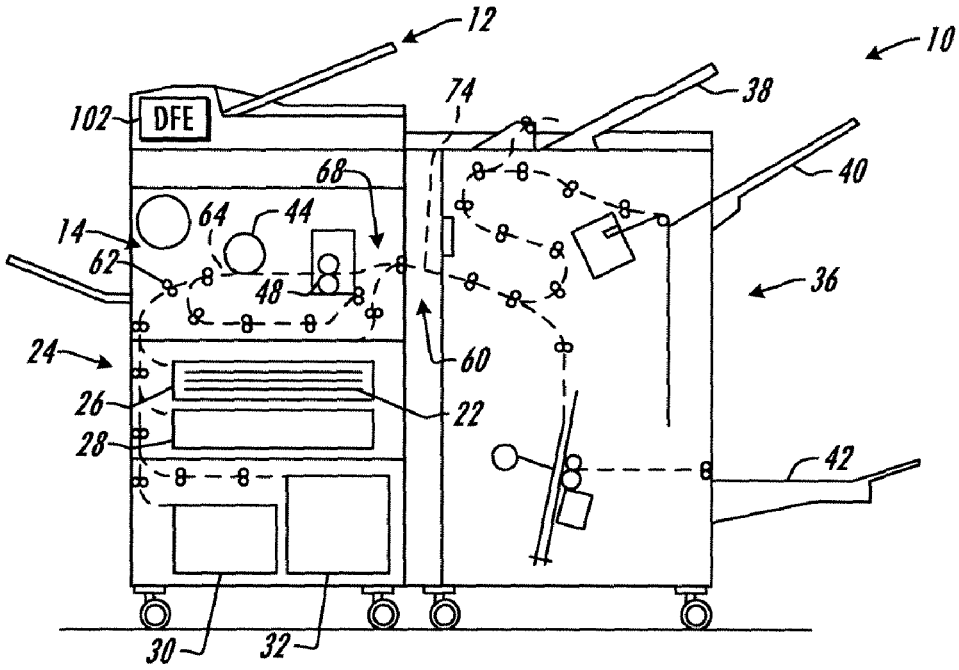
FIG. 1 is a schematic system level diagram illustrating an exemplary document processing system with a control system for controlling a print engine using process control patch images in accordance with one or more aspects of the present disclosure.
Figure 2:
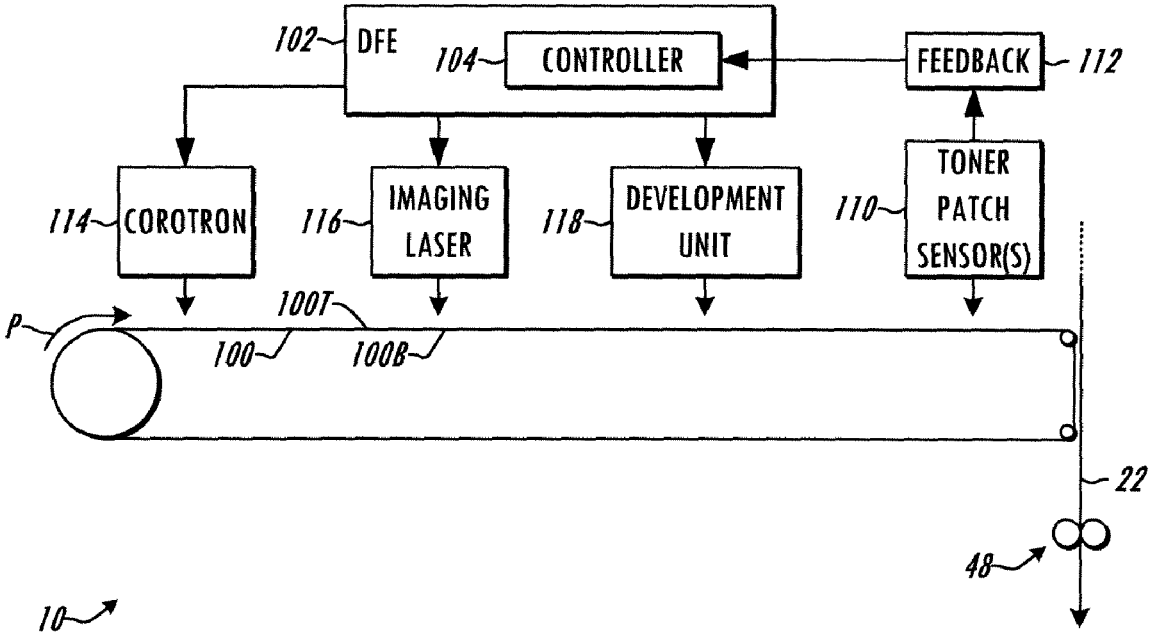
FIG. 2 is a simplified partial side elevation schematic diagram illustrating further details of the printing and control components in the document processing system of FIG. 1.

FIGS. 1 and 2 illustrate an exemplary document processing or printing system 10 in accordance with one or more aspects of the present disclosure. The printing system 10 can be any form of commercial printing apparatus, copier, printer, facsimile machine, or other system which may include a scanner or other input device 12 that scans an original document text and/or images to create an image comprising pixel values indicative of the colors and/or brightness of areas of the scanned original, and which has one or more marking engines or print engines 14 by which visual images, graphics, text, etc. are printed on a page or other printable medium, including xerographic, electro photographic, and other types of printing technology, wherein such components are not specifically illustrated in FIG. 1 to avoid obscuring the various alternate imaging features of the present disclosure. The print engine 14 may be any device or marking apparatus for applying an image from a digital front end (DFE) printer controller 102 to printable media (print media) such as a physical sheet of paper, plastic, or other suitable physical media substrate for images, whether precut or web fed, where the input device 12, print engine 14, and controller 102 are interconnected by wired and/or wireless links for transfer of electronic data therebetween, including but not limited to telephone lines, computer cables, ISDN lines, etc. The print engine 14 generally includes hardware and software elements employed in the creation of desired images by electrophotographic processes wherein suitable print engines 14 may also include ink-jet printers, such as solid ink printers, thermal head printers that are used in conjunction with heat sensitive paper, and other devices capable of printing an image on a printable media.

The image input device 12 may include or be operatively coupled with conversion components for converting the image-bearing documents to image signals or pixels or such function may be assumed by the printing engine 14. In the illustrated document processor 10, the printer controller 102 provides the output pixel data from memory to a print engine 14 that is fed with a print media sheets 22 from a feeding source 24 such as a paper feeder which can have one or more print media sources or paper trays 26, 28, 30, 32, each storing sheets of the same or different types of print media 22 on which the marking engine 14 can print. The exemplary print engine 14 includes an imaging component 44 and an associated fuser 48, which may be of any suitable form or type, and may include further components which are omitted from the figure so as not to obscure the various aspects of the present disclosure.

As best shown in FIG. 2, the printing engine 14 may include a photoconductive insulating member or photoreceptor 100 (FIG. 2) which is charged to a uniform potential via a corotron 114 and exposed to a light image of an original document to be reproduced via an imaging laser 116 under control of a controller 104 of the DFE 102. The exposure discharges the photoconductive insulating surface of the photoreceptor 100 in exposed or background areas and creates an electrostatic latent image on the photoreceptor 100 corresponding to image areas of the original document. The electrostatic latent image on the photoreceptor 100 is made visible by developing the image with an imaging material such as a developing powder comprising toner particles via a development unit 118, and the customer image is then transferred to the print media 22 and permanently affixed thereto in the fusing process.

In a multicolor electrophotographic process, successive latent images corresponding to different colors can be formed on the photoreceptor 100 and developed with a respective toner of a complementary color, with each color toner image being successively transferred to the paper sheet 22 in superimposed registration with the prior toner image to create a multi-layered toner image on the printed media 22, and where the superimposed images may be fused contemporaneously, in a single fusing process. The fuser 48 (FIG. 1) receives the imaged print media from the image-forming component and fixes the toner image transferred to the surface of the print media 22, where the fuser 48 can be of any suitable type, and may include fusers which apply heat or both heat and pressure to an image. Printed media from the printing engine 14 is delivered to a finisher 36 including one or more finishing output destinations 38, 40, 42 such as trays, stackers, pans, etc.

The document processing system 10 is operative to perform these scanning and printing tasks in the execution of print jobs, which can include printing selected text, line graphics, images, machine ink character recognition (MICR) notation, etc., on either or both of the front and back sides or pages of one or more media sheets 22. An original document or image or print job or jobs can be supplied to the printing system 10 in various ways. In one example, the built-in optical scanner 12 may be used to scan an original document such as book pages, a stack of printed pages, or so forth, to create a digital image of the scanned document that is reproduced by printing operations performed by the printing system 10 via the print engine 14. Alternatively, the print jobs can be electronically delivered to the system controller 102 via a network or other means, for instance, whereby a network user can print a document from word processing software running on a network computer, thereby generating an input print job.

In the example of FIG. 1, a print media transporting system or network or highway 60 of the document processing system 10 links the print media source 24, the print engine 14 and a finisher 36 via a network of flexible automatically feeding and collecting drive members, such as pairs of rollers 62, spherical nips, air jets, or the like, along with various motors for the drive members, belts, guide rods, frames, etc. (not shown), which, in combination with the drive members, serve to convey the print media along selected pathways at selected speeds. In the illustrated embodiments, print media 22 is delivered from the source 24 to the print engine 14 via a pathway 64 common to the input trays 26, 28, 30, 32, and is printed by the imaging component 44 and fused by the fuser 48, with a pathway 68 from the print engine 14 merging into a pathway 74 which conveys the printed media to the finisher 36, where the pathways 64, 68, 74 of the network 60 may include inverters, reverters, interposers, bypass pathways, and the like as known in the art. In addition, the print engine 14 may be configured for duplex or simplex printing and a single sheet of paper 22 may be marked by two or more print engines 14 or may be marked a plurality of times by the same marking engine 14, for instance, using internal duplex pathways.

Figure 3:
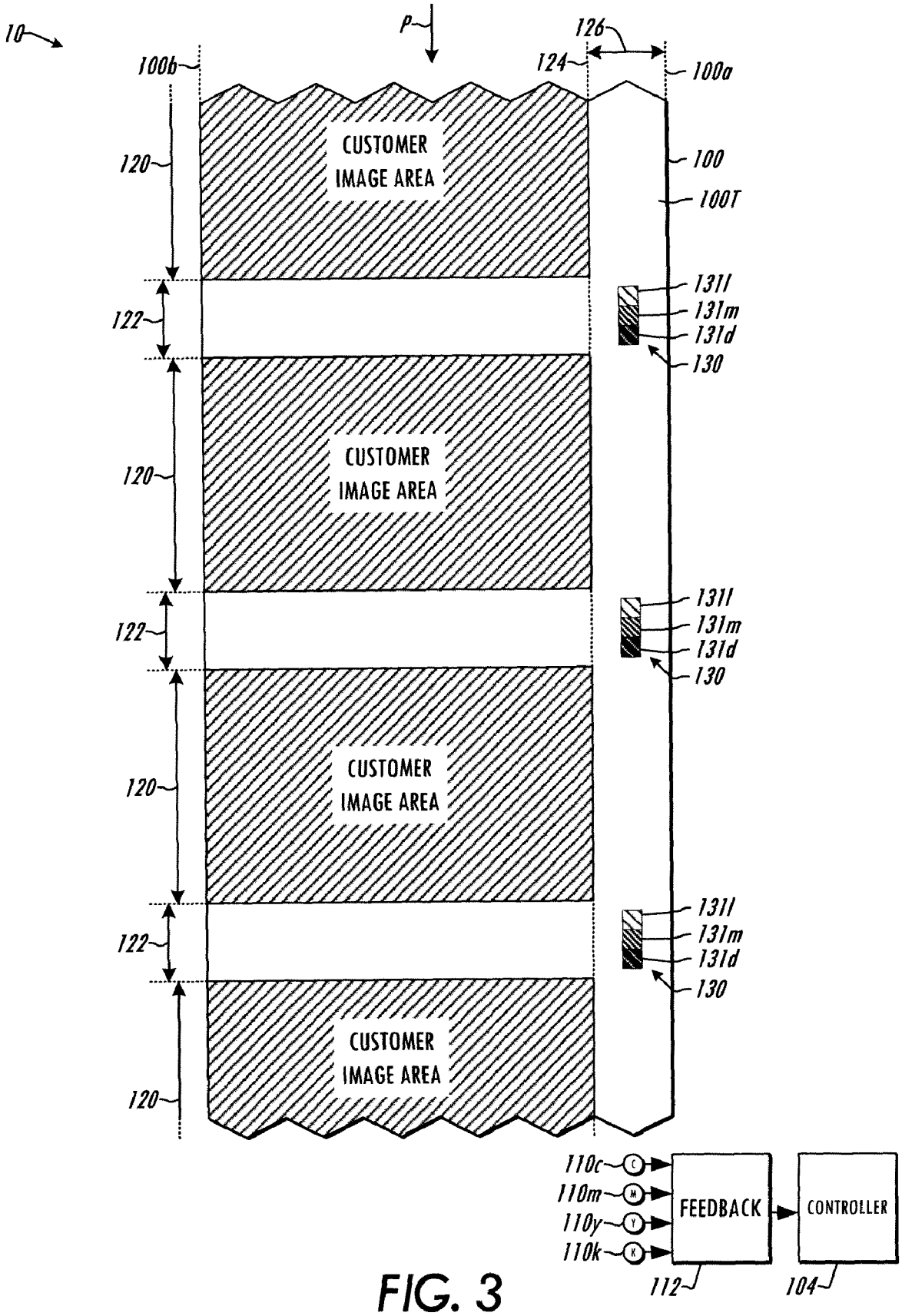
FIG. 3 is a partial top plan view illustrating a top surface of an exemplary photoreceptor structure in the printing system of FIGS. 1 and 2 including process control patch images created in second portions of an edge zone laterally outlying customer image areas on the top surface of the photoreceptor in accordance with various aspects of the present disclosure.

Referring particularly to FIGS. 2 and 3, in accordance with various aspects of the present disclosure, the exemplary document processor 10 comprises a control system including a controller 104 and one or more sensors, such as toner patch sensors 110 providing feedback 112 to the controller with respect to process control or test patch images created on the photoreceptor 100. As best shown in FIG. 2, the illustrated photoreceptor is a belt type structure including a top side 100T and a bottom side 100B. The DFE controller 104 operates the imaging components 114, 116, and 118 to create customer images on the first or top surface 100T as the photoreceptor 100 is translated along the process direction P.

Figure 4:
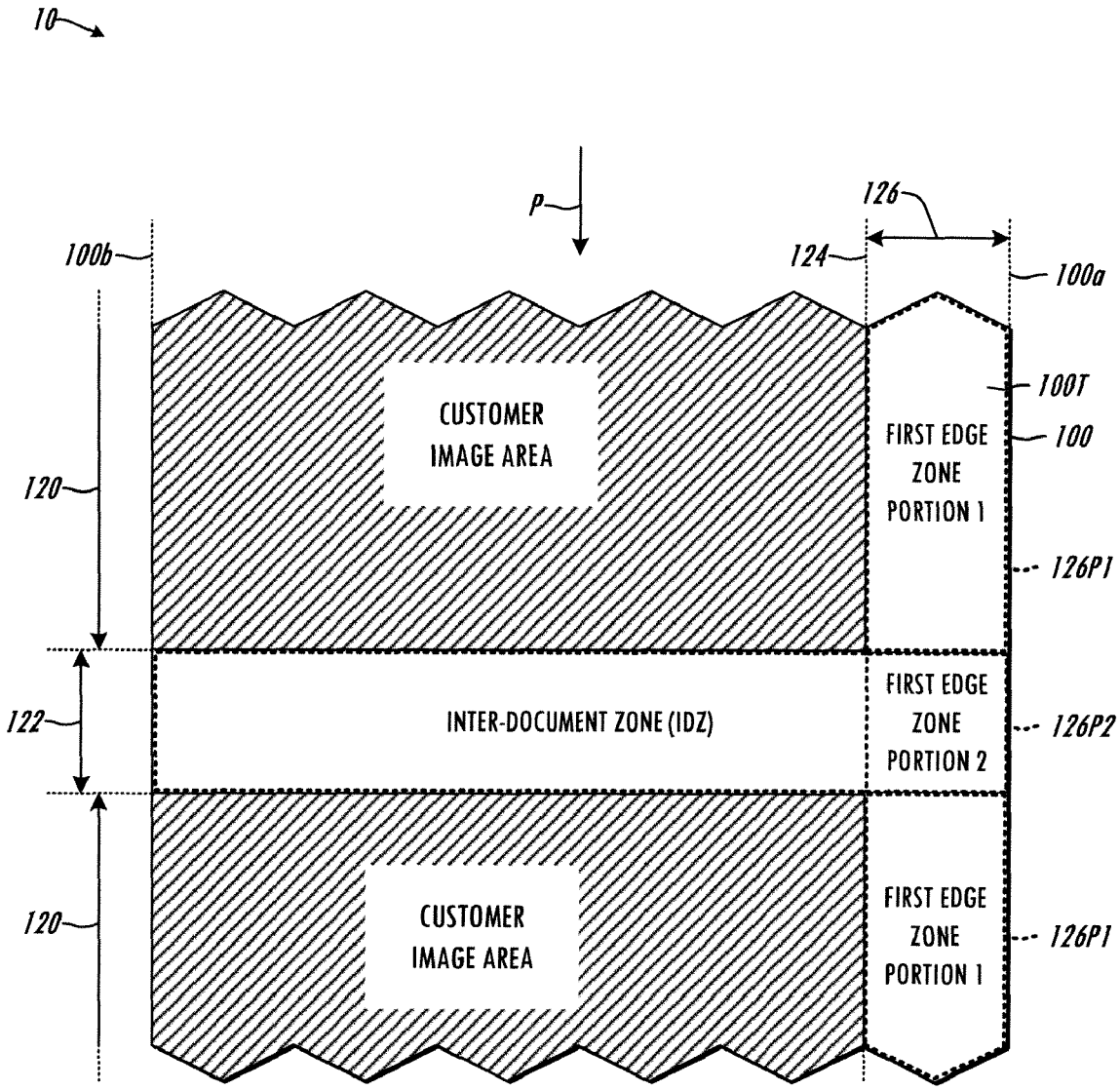
FIG. 4 is an enlarged top plan view illustrating further details of the top photoreceptor surface including a succession of customer image areas to one side of a first lateral boundary and separated from one another along a process direction by an inter-document zone, as well as a first edge zone with a first portion laterally alongside the customer image area and a second portion extending laterally outwardly of the first lateral boundary through the inter-document zone.

As shown in FIGS. 3 and 4, moreover, the first or top side 100T of the photoreceptor 100 has first and second lateral edges 100*a* and 100*b* generally parallel to the process direction P and includes predefined customer image areas 120 with successive customer image areas 120 separated from one another along the process direction P by inter-document zones (IDZs) 122. The individual customer image areas 120 have a first lateral boundary 124 laterally inward of the first photoreceptor edge 100*a* that defines a first edge zone 126 with a first edge zone portion 126P1 (FIG. 4) laterally outside the customer image area 120 between the first lateral boundary 124 and the first photoreceptor edge 100*a* and a second portion 126P2 extending laterally outwardly of the first lateral boundary 124 through the IDZ 122.

The controller 104 causes the imaging components 114, 116, and 118 (FIG. 2) to create at least one process control patch image 130 (FIG. 3) within the first edge zone 126 of the photoreceptor top side 100T, where the example of FIG. 3 includes process control patch images 130 created in second portions 126P2 of the first edge zone 126 laterally outlying (e.g., alongside) the customer image areas 120. As shown in FIG. 3, moreover, the individual patch images 130 include a light portion 131*l*, a medium portion 131*m*, and a dark portion 131*d*, where successive patch images 130 may be of different colors, such as cyan (c), magenta (m), yellow (y), and black (k). Other implementations are possible in which individual control patch images 130 only include one portion (e.g., light, medium, or dark).

In the illustrated implementation, moreover, corresponding toner patch sensors 110*c*, 110*m*, 110*y*, and 110*k* are located along the edge zone path of the translating photoreceptor 100 so as to allow sensing of the process control patch images 130 as they move along the process direction P. The measurements of the process control patch images 130 are provided from the sensor(s) 130 as feedback 112 signals or data to the controller 104 of the DFE 102 for use in adjusting the operational parameters of the imaging components used in creating customer images in the customer image areas 120 of the photoreceptor 100 in closed loop fashion.

Figure 12:
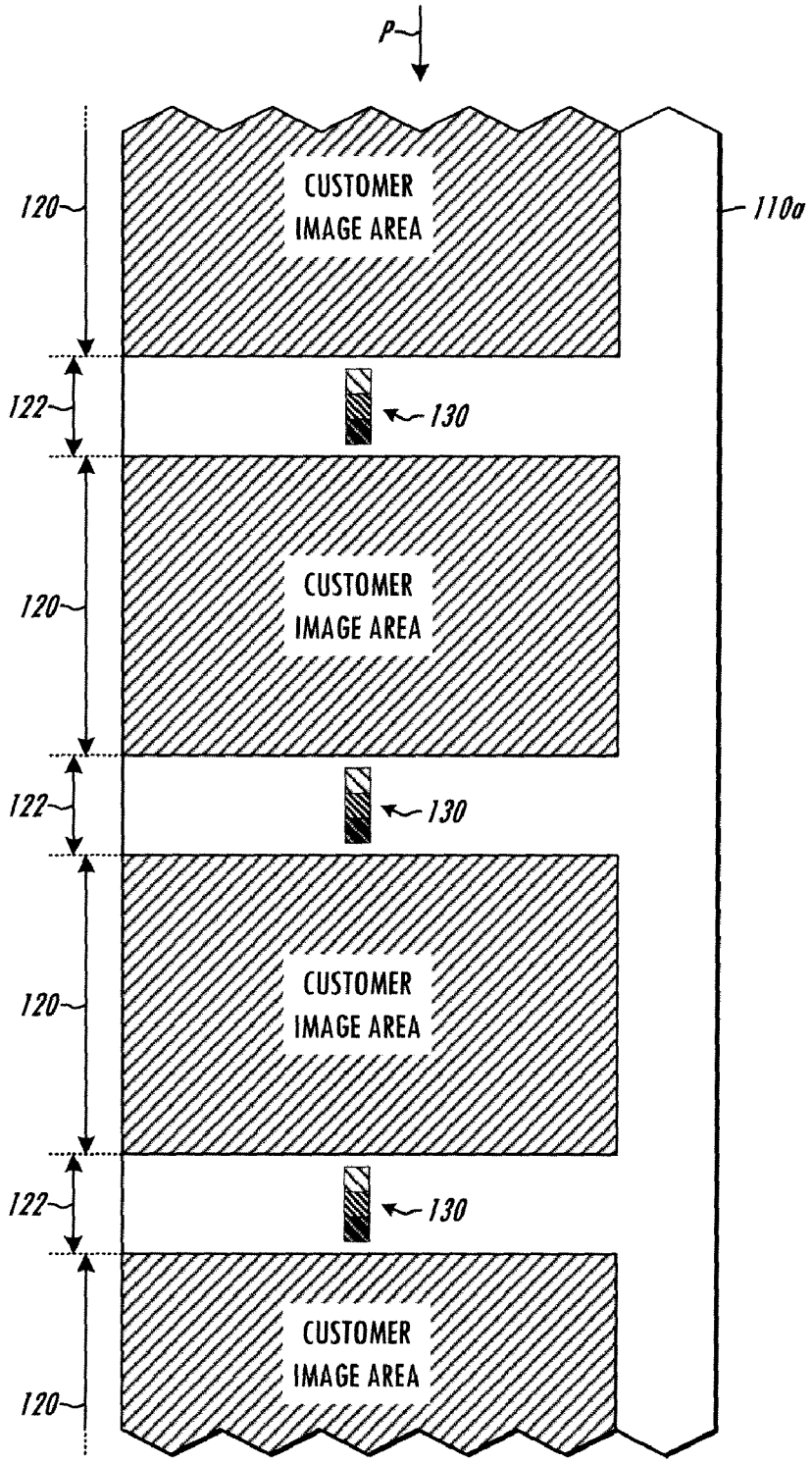
FIG. 12 (PRIOR ART)
FIG. 12 is a partial top plan view illustrating a top surface of a conventional photoreceptor structure including process control patch images created in an inter-document zone between successive customer image areas.

The inventors have appreciated that system performance shortfalls in the print engine 14 may cause undesirable interaction between the control patches and the customer images where the control patches 130 are located axially between adjacent customer image areas 120 as in the example of FIG. 12, leading to distortion in the measured control patch images and/or customer images. Distortion in the measured control patch image feedback would cause errors in the closed loop control of the print engine. By the technique shown in FIG. 3, the control patches 130 are moved beyond the lateral extent of the customer image areas 120 so as to decouple image development system deficiencies with respect to customer images from the process control patch images. As a result, the ability to control the print engine in closed loop fashion will not be adversely impacted by system performance degradation since the measured control patch feedback 112 will not be influenced by the presence or absence of customer images in the areas 120, but will instead be affected only by the performance of the imaging components of the system 10. Thus, the controller 104 receives the patch sensor feedback 112 and controls the creation of the customer images in closed-loop fashion at least partially according to the measured control patch feedback information 112.

Figure 5:
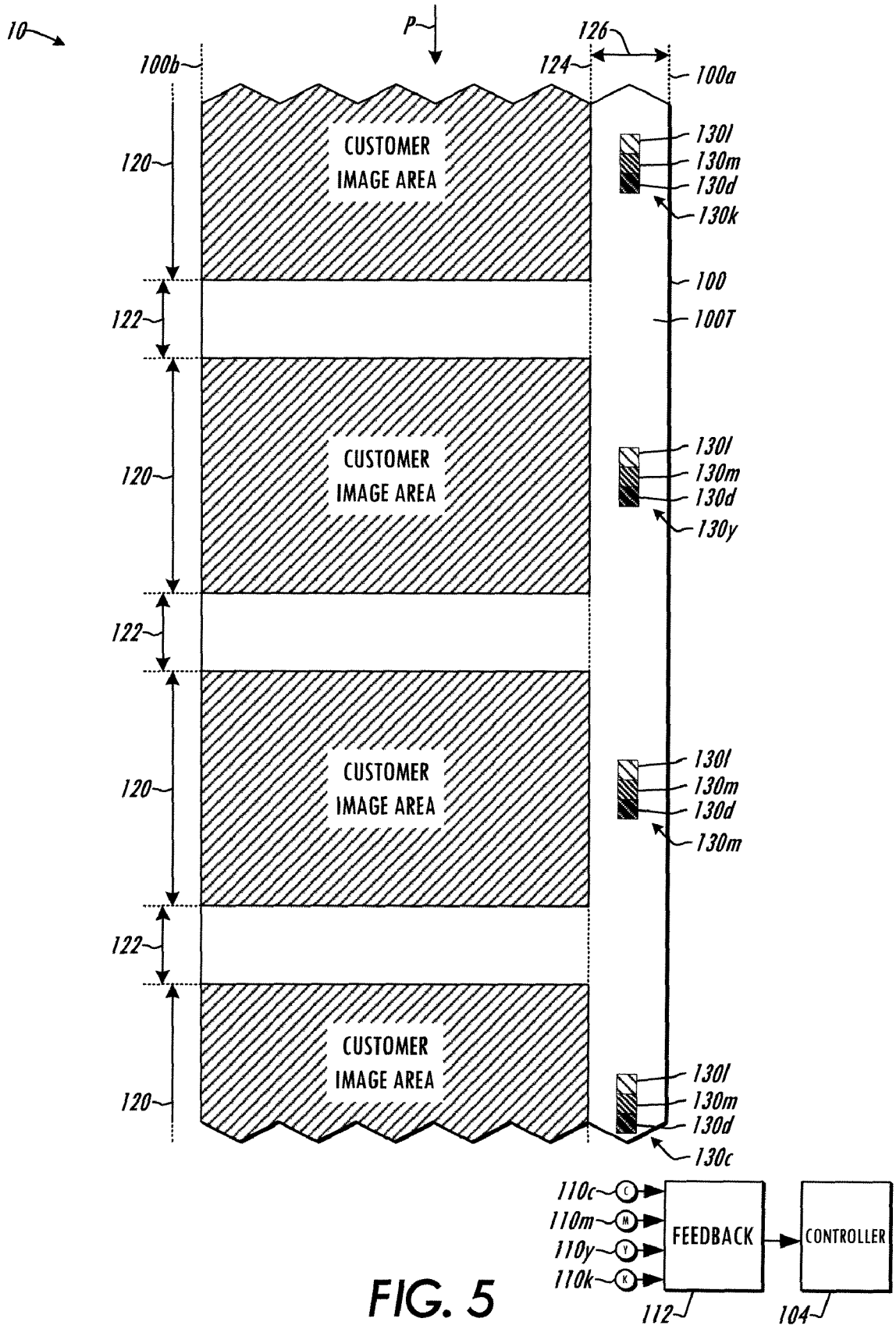
FIG. 5 is a partial top plan view illustrating a top surface of another exemplary photoreceptor structure in the printing system of FIGS. 1 and 2 including process control patch images created in the first portions of the edge zone outlying the customer image areas.

FIG. 5 illustrates another example in which the controller 104 causes creation of process control patch images in the first portion 126P1 of the first edge zone 126. In this case, a single test patch image 130 with light, medium, and dark portions 131*l*, 131*m*, and 131*d*, respectively, is created in the first portion 126P1 alongside each customer image area 120 with successive control patch images being of different colors, such as cyan (patch 130*c*), magenta (patch 130*m*), yellow (130*y*), and black (patch 130*k*). Other embodiments are possible in which a control patch 130 is provided alongside every other customer image area 120, and other spacings may be provided in alternate implementations within the scope of the present disclosure.

Figure 6:
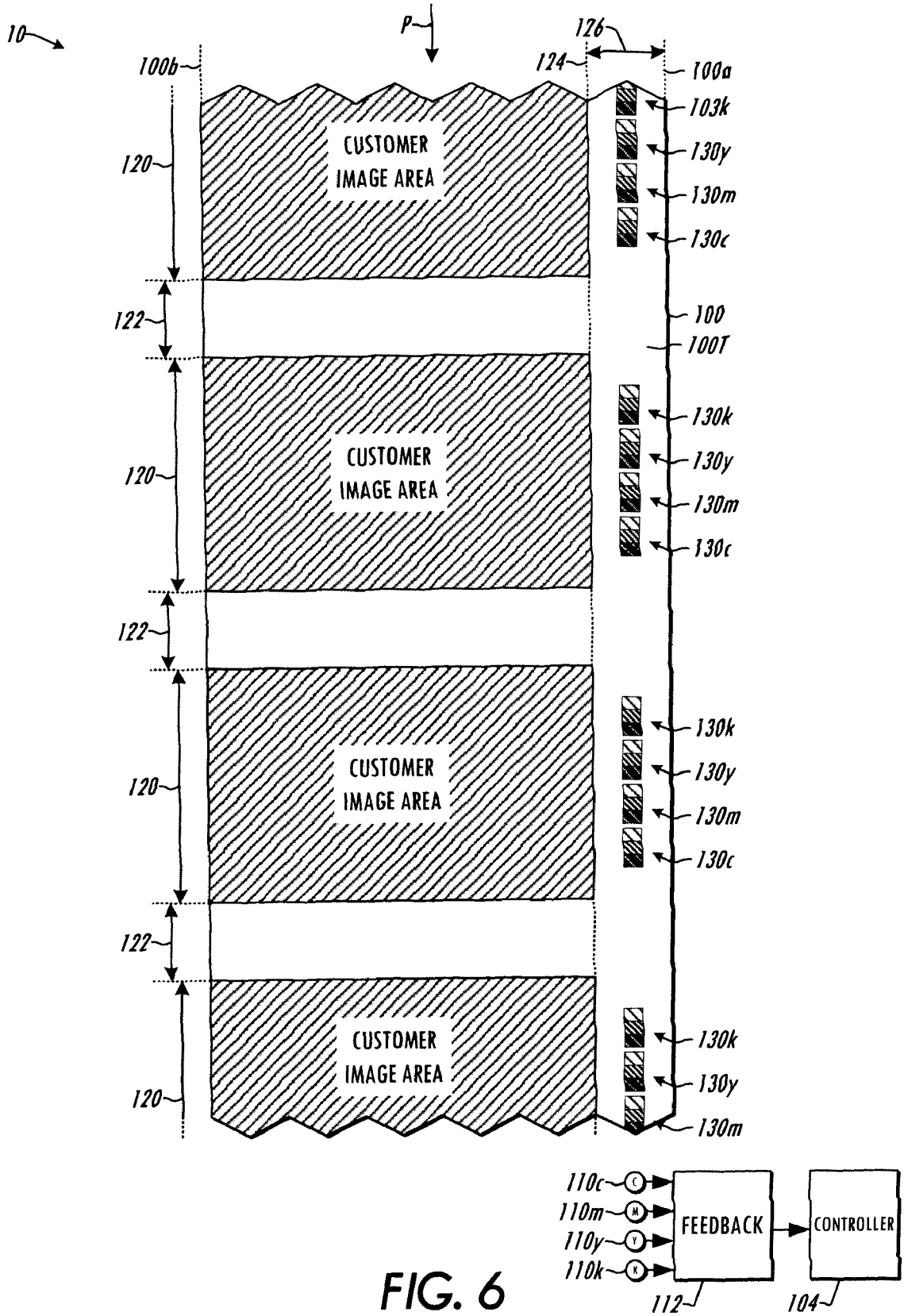
FIG. 6 is a partial top plan view illustrating a top surface of another exemplary photoreceptor structure including a plurality of axially aligned different colored process control patch images created in the edge zone outlying the customer image areas.

FIG. 6 illustrates yet another exemplary embodiment in which multiple control patch images 130 are created alongside each customer image area 120, wherein at least two patches 130 are in a given first edge zone portion 126P1. In this embodiment, moreover, different colored process control patch images 130*c*, 130*m*, 130*y*, and 130*k* are created in the first portions 126P1 alongside each customer image area 120, although not a strict requirement of the broader aspects of the present disclosure. In the embodiment of FIG. 6, the differently colored test patches 130 are axially aligned with one another in the first portions 126P1 of the first edge zone 126 and the corresponding toner patch sensors 110 are also axially aligned relative to the process direction P although alternate implementations are possible without such axial alignment.

Figure 7:
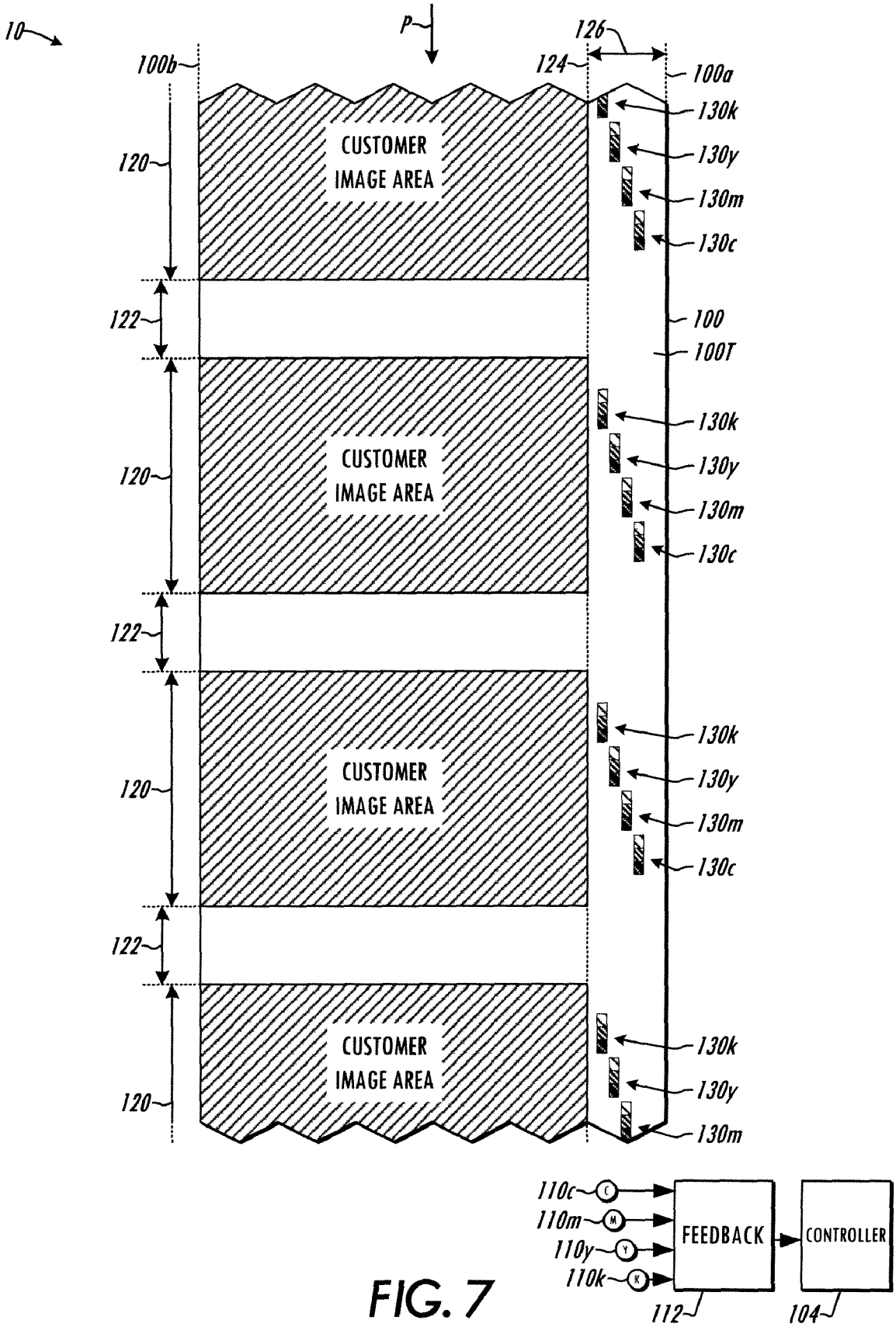
FIG. 7 is a partial top plan view illustrating a top surface of another exemplary photoreceptor structure including a plurality of different colored process control patch images created in staggered arrangements in the first portions of the edge zone.

FIG. 7 illustrates another possible implementation, in which multiple control patch images 130 are again created alongside each customer image area 120 in one or more of the first edge zone portions 126P1, with different colored process control patch images 130*c*, 130*m*, 130*y*, and 130*k* created in the first portions 126P1. In this embodiment, the different colored process control patch images 130 are created in staggered arrangements in the first portions 126P1 of the edge zone 126 with four differently colored patch images 130*c*, 130*m*, 130*y*, and 130*k* within each of the edge zone first portions.

Figure 8:
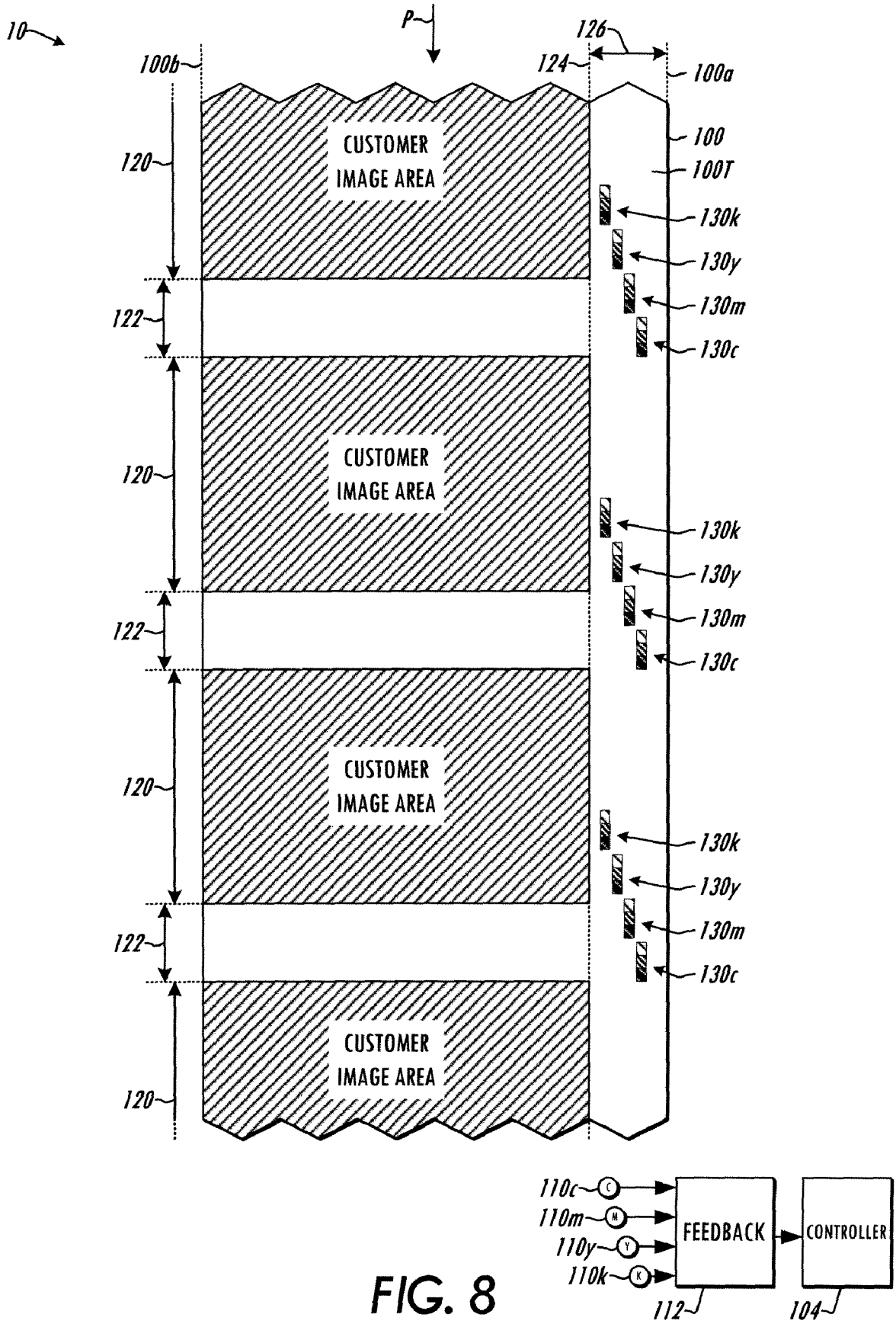
FIG. 8 is a partial top plan view illustrating a top surface of another exemplary photoreceptor structure including a plurality of different colored process control patch images created in staggered arrangements in the first and second portions of the edge zone.

FIG. 8 illustrates still another embodiment including a plurality of different colored process control patch images 130*c*, 130*m*, 130*y*, and 130*k* created in staggered arrangements in the first and second portions of the edge zone. In this regard, different control patch images 130 can be created in the first and second edge zone portions 126P1 and 126P2 and individual patch images 130 can straddle the two portions 126P1 and 126P2, wherein all such variant implementations are possible within the scope of the present disclosure in which at least one patch image 130 is created in the edge zone 126 laterally outlying the boundary 124 of the customer image areas 120.

Figure 9:
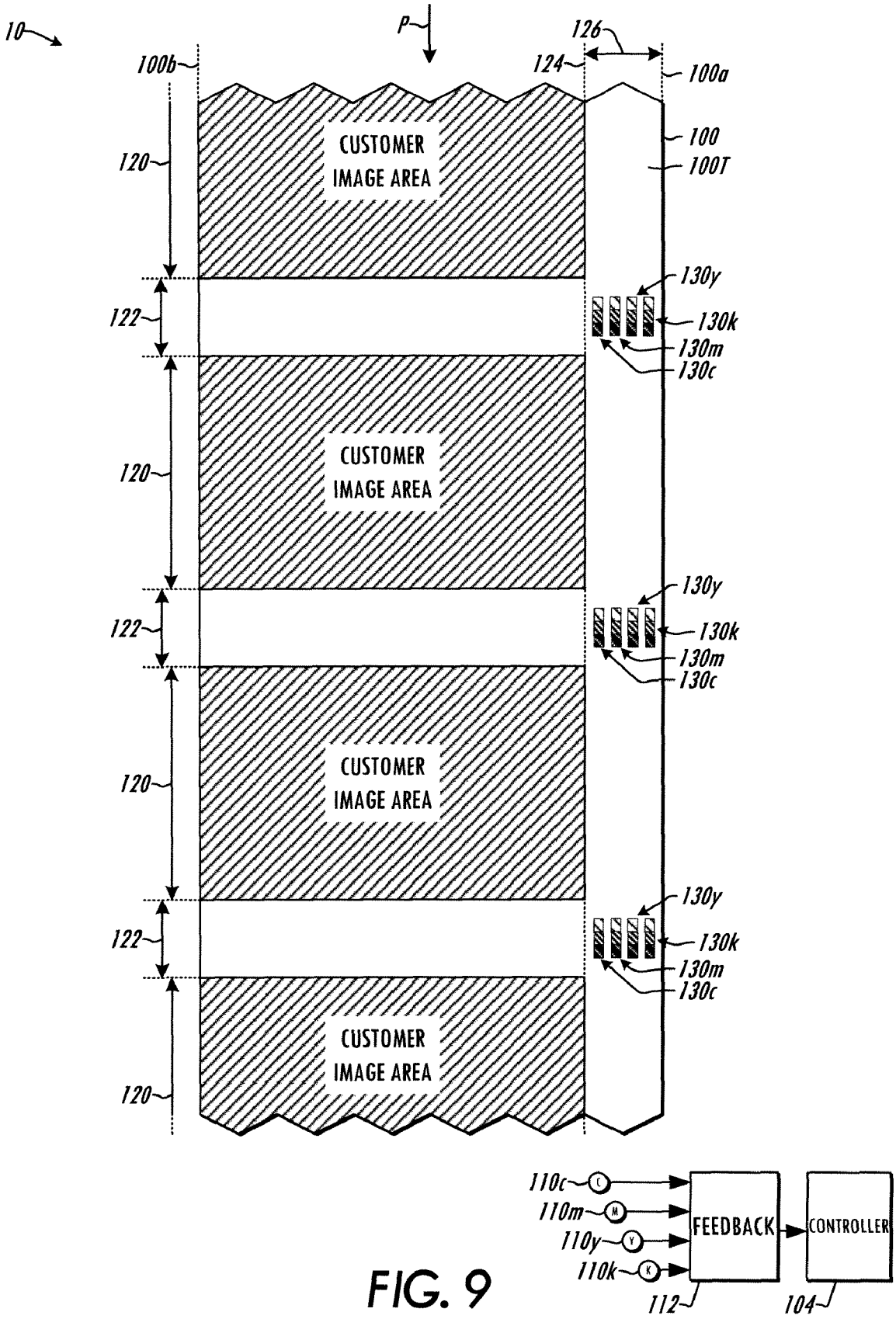
FIG. 9 is a partial top plan view illustrating a top surface of another exemplary photoreceptor structure including a plurality of laterally aligned different colored process control patch images created in the second portions of the edge zone.

FIG. 9 shows yet another exemplary photoreceptor structure 100 including a plurality of different colored process control patch images 130*c*, 130*m*, 130*y*, and 130*k* that are laterally aligned with respect to one another in a direction perpendicular to the process direction P, where the patches 130 in this embodiment are created in the second portions 126P2 of the edge zone 126 along the first side 100*a* of the photoreceptor 100. In this example, the control system provides for location of the corresponding toner patch sensors 110*c*, 110*m*, 110*y*, 110*k* at different lateral distances from the edge 100*a* so as to be able to sense the corresponding test patch images 130 as the photoreceptor structure 100 is translated along the process direction P.

Figure 10:
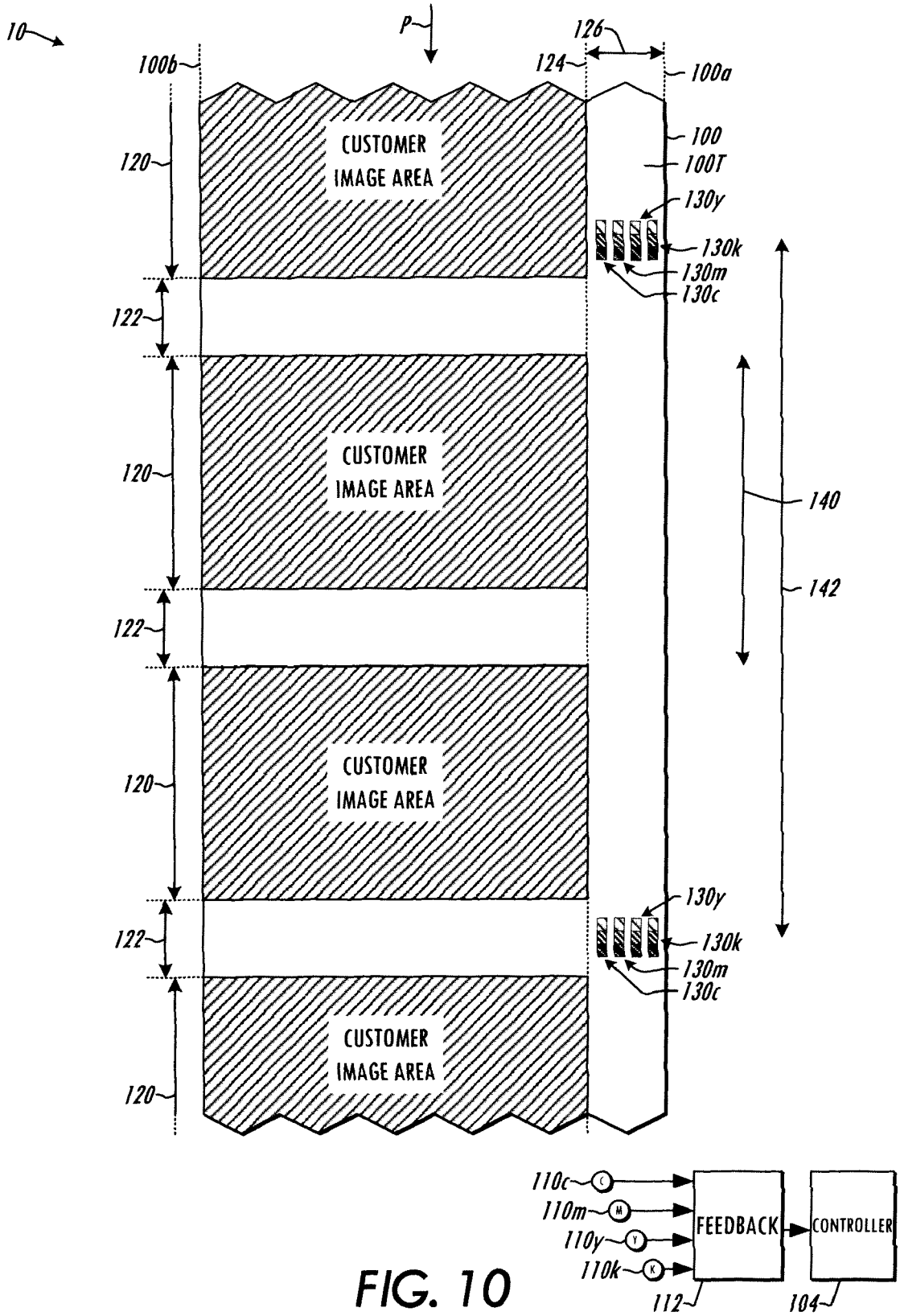
FIG. 10 is a partial top plan view illustrating a top surface of another exemplary photoreceptor structure including a plurality of laterally aligned different colored process control patch images created in the first and second portions of the edge zone.

As shown in FIG. 10, moreover, the spacing of successive process control patches 130 or groups thereof, need not be the same as the spacing between successive customer image areas 120. In the implementation of FIG. 10 a plurality of laterally aligned different colored process control patch images 130 are created in the first and second portions of the edge zone 126, where the spacing 140 between successive customer image areas 120 is different than the spacing 142 between successive groups of process control patch images 130.

In accordance with further aspects of the present disclosure, the customer image areas 120 may have a second lateral boundary 124*a* laterally inward of the second photoreceptor edge 100*b* to thus define a second edge zone 126*a* that itself has a first portion laterally outside the customer image area 120 between the second lateral boundary 124*a* and the second photoreceptor edge 100*b*, as well as a second portion extending laterally outwardly of the second lateral boundary 124*a* through the inter-document zone 122.

Figure 11:
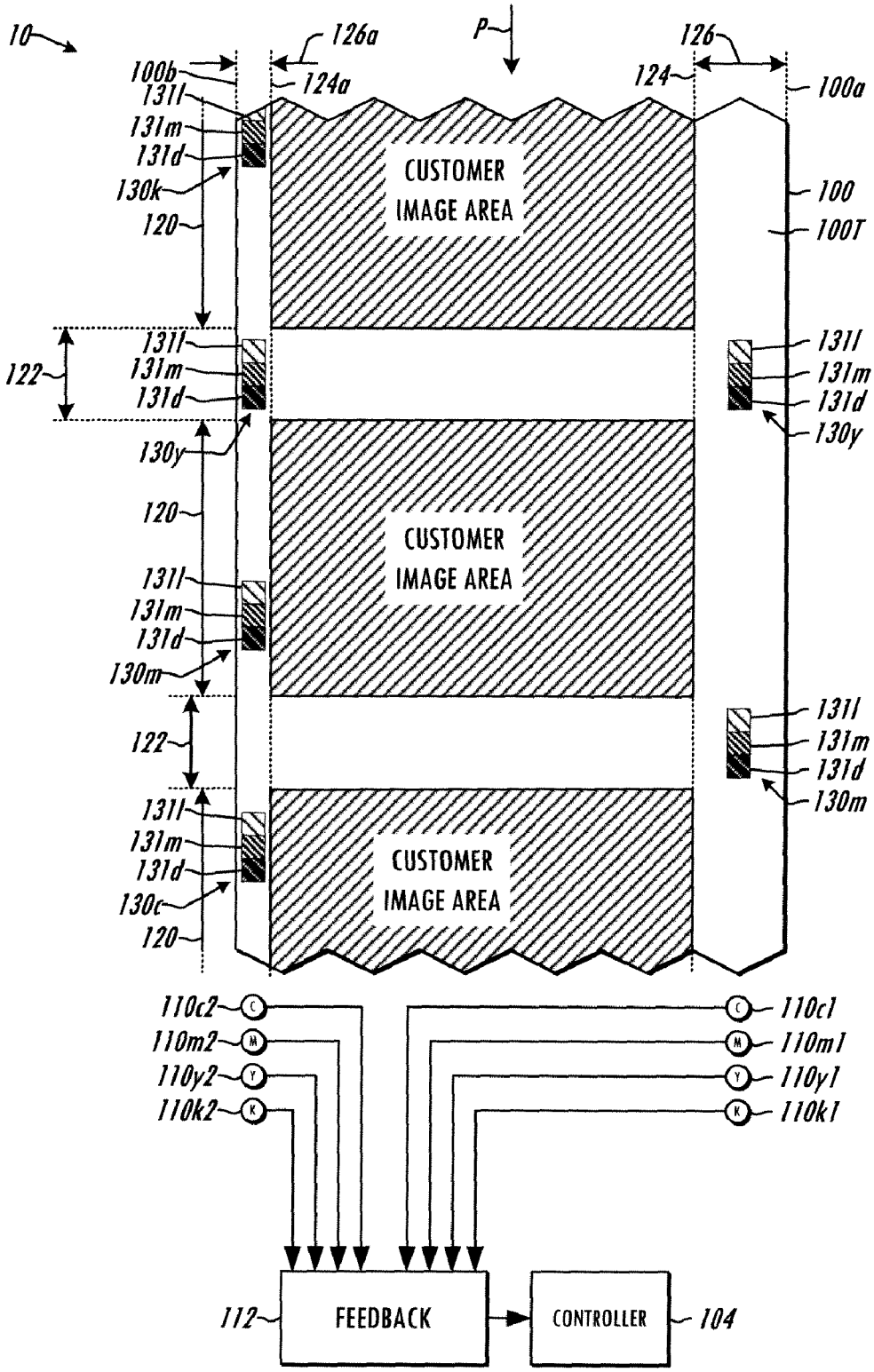
FIG. 11 is a partial top plan view illustrating a top surface of another exemplary photoreceptor structure including process control patch images created in first and second edge zones laterally outlying the customer image areas.

FIG. 11 illustrates yet another exemplary photoreceptor structure 100 that includes process control patch images 130 created in such first and second edge zones 126 and 126*a*, respectively, each laterally outlying the customer image areas 120, where the edge zones 126, 126*a* may, but need not, be of the same width. Again, this approach essentially decouples any system performance issues with respect to the process control patch images 130 and the images of the customer image areas 120. In this case, the controller 104 causes the imaging component(s) to create another process control patch image 130 within the second edge zone 126*a* and corresponding sensors are provided along each edge zone 126, 126*a* of the photoreceptor structure 100. In the example of FIG. 11, moreover, different colored patches 130 and sensors 110 are provided along each edge zone 126, 126*a* for corresponding sensing whereby the feedback control can accommodate laterally varying adjustments. In this embodiment, a first set of cyan, magenta, yellow, and black sensors 110*c*1, 110*m*1, 110*y*1, and 110*k*1 are provided to sense control patch images 130 of the first edge zone 126, and a second set of cyan, magenta, yellow, and black sensors 110*c*2, 110*m*2, 110*y*2, and 110*k*2 are provided to sense control patch images 130 of the second edge zone 126*a*.

The above examples are merely illustrative of several possible embodiments of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been disclosed with respect to only one of several embodiments, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising". It will be appreciated that various of the above-disclosed and other features and functions, or alternatives thereof, may be desirably combined into many other different systems or applications, and further that various presently unforeseen or unanticipated alternatives, modifications, variations or improvements therein may be subsequently made by those skilled in the art which are also intended to be encompassed by the following claims.

The invention claimed is:

1. A method for controlling a print engine in a printing system, the method comprising:

translating a photoreceptor structure along a process direction in the printing system, the photoreceptor structure having first and second lateral edges generally parallel to the process direction and a first side extending between the first and second lateral edges;

creating a plurality of images on the first side of the photoreceptor structure, each image being located within a corresponding predefined customer image area of the photoreceptor first side with successive customer image areas being separated from one another along the process direction by an inter-document zone, where the customer image areas have a first lateral boundary laterally inward of the first photoreceptor edge and defining a first edge zone of the first side with a first portion laterally outside the customer image area between the first lateral boundary and the first photoreceptor edge and a second portion extending laterally outwardly of the first lateral boundary through the inter-document zone, and wherein the customer image areas have a second lateral boundary laterally inward of the second photoreceptor edge and defining a second edge zone with a first portion laterally outside the customer image area between the second lateral boundary and the second photoreceptor edge and a second portion extending laterally outwardly of the second lateral boundary through the inter-document zone;

creating a plurality of process control patch images entirely within the second portion of the first edge zone of the photoreceptor without creating any process control patch images within the first portion of the first edge zone;

creating another process control patch image within the second edge zone of the photoreceptor; and sensing the control patch images within the first and second edge zones of the photoreceptor to generate measured control patch feedback information; and controlling the creation of the plurality of images in closed-loop fashion at least partially according to the measured control patch feedback information.

2. The method of claim 1, comprising creating a plurality of process control patch images of different colors entirely within the second portion of the first edge zone of the photoreceptor.

3. The method of claim 1, wherein the plurality of process control patch images include process control patch images of at least two different colors.

4. A printing system, comprising:

a photoreceptor structure translated along a process direction in the printing system, the photoreceptor structure having first and second lateral edges generally parallel to the process direction and a first side extending between the first and second lateral edges, the photoreceptor first side including predefined customer image areas with successive customer image areas separated from one another along the process direction by an inter-document zone, the customer image areas having a first lateral boundary laterally inward of the first photoreceptor edge and defining a first edge zone of the first side with a first portion laterally outside the customer image area between the first lateral boundary and the first photoreceptor edge and a second portion extending laterally outwardly of the first lateral boundary through the inter-document zone, and wherein the customer image areas have a second lateral boundary laterally inward of the second photoreceptor edge and defining a second edge zone with a first portion laterally outside the customer image area between the second lateral boundary and the second photoreceptor edge and a second portion extending laterally outwardly of the second lateral boundary through the inter-document zone;

an imaging component located in a fixed position relative to the translating photoreceptor structure and operative to create a plurality of images within the predefined customer image areas of the photoreceptor first side, to create a plurality of process control patch images within the second portion of the first edge zone of the photoreceptor without creating any process control patch images within the first portion of the first edge zone, and to create another process control patch image within the second edge zone of the photoreceptor;

at least one sensor operative to sense the control patch images of the first edge zone and to generate measured control patch feedback information;

a second sensor operative to sense control patch images in the second edge zone and to generate measured control patch feedback information; and a controller operatively coupled to receive the feedback information from the first and second sensors and to control the creation of the plurality of images in closed-loop fashion at least partially according to the measured control patch feedback information from the first and second sensors.

5. The printing system of claim 4, wherein the imaging component creates a plurality of process control patch images of different colors entirely within the second portion of the first edge zone of the photoreceptor.

* * * * *